US006626178B2

(12) United States Patent
Morgan et al.

(10) Patent No.: US 6,626,178 B2
(45) Date of Patent: Sep. 30, 2003

(54) FULL FACE MASK WITH FACE SEAL AND REMOVABLE ADAPTORS ALLOWING FULL ACCESS TO SEPARATE SPACES

(75) Inventors: William Bevly Morgan, Santa Barbara, CA (US); Connie Lyn Morgan, Santa Barbara, CA (US); Trent Matthew Schultz, Santa Barbara, CA (US); Peter Mark Ryan, Santa Barbara, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 0 days.

(21) Appl. No.: 09/758,136

(22) Filed: Jan. 12, 2001

(65) Prior Publication Data

US 2002/0129818 A1 Sep. 19, 2002

(51) Int. Cl.[7] ..... A62B 18/08; B63C 11/02

(52) U.S. Cl. ..... 128/206.26; 128/206.23; 128/201.27

(58) Field of Search ..... 128/201.22–201.24, 128/201.29, 202.11, 202.19, 202.18, 201.27, 206.12–206.19, 206.21–206.29, 207.11, 207.13, 207.18, 207.27; 2/410, 6.3–6.5, 5, 10, 422–429, 202, 205

(56) References Cited

U.S. PATENT DOCUMENTS

| | | | | | |
|---|---|---|---|---|---|
| 1,371,236 | A | | 3/1921 | Geer et al. | |
| 2,362,643 | A | | 11/1944 | Lambertsen | 128/142 |
| 2,456,130 | A | | 12/1948 | Lambertsen | 128/142 |
| 2,597,764 | A | | 5/1952 | Tucker et al. | 2/3 |
| 2,821,192 | A | * | 1/1958 | Monro | 128/201.15 |
| 3,037,501 | A | | 6/1962 | Miller | 128/141 |
| 3,181,531 | A | * | 5/1965 | Angioletti | 128/201.19 |
| 3,292,618 | A | | 12/1966 | Davis et al. | 128/142 |
| 3,433,222 | A | | 3/1969 | Pinto | 128/142.2 |
| 3,563,236 | A | * | 2/1971 | Hansson | 128/201.15 |
| 3,653,086 | A | * | 4/1972 | Gongwer | 128/201.11 |
| 3,672,365 | A | | 6/1972 | Morgan | 128/141 R |
| 3,680,556 | A | | 8/1972 | Morgan | 128/142.2 |
| 3,845,768 | A | | 11/1974 | Garrahan | 128/142.7 |
| 3,958,275 | A | | 5/1976 | Morgan et al. | 2/2.1 R |
| 4,029,092 | A | | 6/1977 | Morgan | 128/141 R |
| 4,157,090 | A | * | 6/1979 | Phillips | 128/207.11 |
| 4,167,185 | A | * | 9/1979 | Lewis | 128/206.24 |
| 4,250,877 | A | | 2/1981 | Owens et al. | 128/207.11 |
| 4,352,353 | A | | 10/1982 | Bolton et al. | 128/201.24 |
| 4,373,520 | A | * | 2/1983 | Arbique | 128/201.19 |
| 4,402,316 | A | | 9/1983 | Gadberry | 128/201.15 |
| 4,470,413 | A | | 9/1984 | Warncke | 128/201.18 |
| 4,595,003 | A | * | 6/1986 | Shoemaker et al. | 128/201.19 |
| 4,648,394 | A | * | 3/1987 | Wise | 128/201.24 |
| 4,676,236 | A | | 6/1987 | Piorkowski et al. | 128/201.23 |
| 5,219,368 | A | * | 6/1993 | Page | 128/201.24 |
| 5,245,993 | A | | 9/1993 | McGrady et al. | 128/201.22 |
| 5,279,286 | A | | 1/1994 | Chen | 128/201.19 |
| 5,349,949 | A | | 9/1994 | Schegerin | 128/206.24 |
| 5,411,021 | A | | 5/1995 | Gdulla et al. | 128/201.15 |
| 5,455,842 | A | | 10/1995 | Mersky et al. | 375/175 |
| 5,553,331 | A | * | 9/1996 | Gentile | 2/430 |
| 5,575,278 | A | * | 11/1996 | Bonhomme et al. | 128/201.22 |
| 5,653,225 | A | * | 8/1997 | Schegerin | 128/201.22 |
| 5,764,332 | A | * | 6/1998 | Kranhouse | 351/43 |
| 5,839,432 | A | * | 11/1998 | Daneshvar | 128/201.25 |
| 5,957,132 | A | * | 9/1999 | McDonald et al. | 128/206.21 |
| 5,964,218 | A | * | 10/1999 | Smith et al. | 128/201.25 |
| 6,016,805 | A | * | 1/2000 | Burns et al. | 128/200.28 |

FOREIGN PATENT DOCUMENTS

| | | | | |
|---|---|---|---|---|
| EP | 0303090 | * | 2/1989 | 128/201.25 |
| GB | 2 228 420 | | 8/1990 | |
| WO | 98/03225 | | 1/1998 | |

* cited by examiner

*Primary Examiner*—Weilun Lo
*Assistant Examiner*—Teena Mitchell
(74) *Attorney, Agent, or Firm*—Jacobson Holman PLLC

(57) ABSTRACT

A flexible full face mask to supply breathable air to humans when in environments where it is not possible to breathe, such as underwater masks, or in environments having toxic gases or similar toxic conditions. The mask includes a mask skirt in the form of a one-piece flexible face seal and separate rigid frame components which define separated self-contained spaces that are connected together in a manner to allow each self-contained space to individually conform and seal against the contours of the face of the wearer. The mask also includes a removable adaptor pod mounted on a lower of the frame components to enable full access to the mouth of the wearer while maintaining the mask in sealed relation on the facial surfaces of the wearer.

14 Claims, 9 Drawing Sheets

FULL FACE MASK WITH FACE SEAL AND REMOVABLE ADAPTORS ALLOWING FULL ACCESS TO SEPARATE SPACES

BACKGROUND OF THE INVENTION

1. Field of the Invention

The present invention generally relates to full face masks to supply breathable air to humans when in environments where it is not possible to breathe, such as underwater masks, or in environments having toxic gases or similar contaminated conditions.

2. Description of the Prior Art

It is necessary to maintain breathing capabilities, vision capabilities and communication capabilities when human beings or other animals are positioned in environments in which unbreathable circumstances exist, such as, but not limited to, underwater, atmospheres of noxious or toxic gases or in atmospheres where the supply of oxygen is insufficient. Divers, for example, when they submerge below water, must be provided with breathable air, vision and communication capabilities for survival and effective function. Various types of diving helmets, face masks and the like have been developed that enable underwater breathing and underwater vision and communication. Likewise, breathable air must be provided to individuals subject to environments having toxic conditions. Various masks have also been provided for use in unbreathable atmospheres such as those frequently encountered by firemen, chemical warfare participants or those encountering other conditions where an unbreathable environment exists.

In the current state of the art, scuba divers wear a mask that covers his/her eyes and nose. This type of mask is sometimes called a "half mask" to differentiate it from a full face mask that covers the entire face. In a half mask, a rubber skirt seals against the diver's face around the outer sides of the eyes across the forehead and under the nose across the face above the upper lip. A clear lens through which the diver can see when underwater and when on the surface of the water forms the exterior of the front of the mask. Placing the diver's nose in the mask protects the nose from the surrounding water and the nose can be used to blow air/gas into the mask to equalize the necessary air/gas cavity space with the increasing water pressure when descending.

The scuba diver's mouth is outside of the half mask and is exposed to the water in which he/she swims. A resilient rubber mouthpiece, shaped to fit between the outer side of the teeth and gums and the inside of the lips allows a somewhat tight water seal. The center of the mouthpiece forms a tube that extends forward from the diver's lips so that the outer end of the mouthpiece can be connected to a breathing system. The diver inhales and exhales through this tube. Adjacent to the center of the inside opening of this tube on each side are located two "bits" which the diver bites down on to retain the mouthpiece in his/her mouth. It is necessary for the diver to keep the mouthpiece bits clamped in his/her teeth with the lips held snug on the mouthpiece to seal out the water. Minor amounts of water leak into the diver's mouth from time to time. Although irritating, this is not usually a serious concern. The use of the mouthpiece becomes second nature to the diver after a short time, and is not a problem so long as the diver is conscious and coherent, not tired and does not accidentally dislodge the mouthpiece. This system is called an eye/nose mask or half mask and mouthpiece system.

This mouthpiece system has been in use since the 1930s. It was widely used by World War II underwater combat teams with rebreathers as the breathing system. This mouthpiece system was adapted by J. Y. Cousteau with his invention of an open circuit breathing system called the "Aqua Lung" (now a trademark of USD Corp.). This system has been in use for over 50 years.

For the conscious, coherent scuba diver who is submerged in clean, warm water, the eye/nose mask and separate mouthpiece is a very good system. Underwater, if the breathing system malfunctions, the diver can open his/her mouth to get rid of the mouthpiece of the malfunctioning breathing device and insert a mouthpiece of another breathing device that he/she carries as a spare, or can use a breathing device provided by another diver. This is an important safety consideration that is part of the training and confidence building necessary for scuba diving.

Conserving the limited self contained air/gas supply is important for scuba diving. Prior to entering the water, the diver can put on all of his/her equipment without the necessity of using the air/gas supply. Just prior to water entry the breathing regulator mouthpiece is placed in the mouth. After water entry, sometimes a surface swim to the dive site is necessary. The diver can further conserve his air/gas supply by using a snorkel for the swim and later inserting the mouthpiece to dive.

Upon return to the surface, a scuba diver can drop his/her breathing device mouthpiece and breathe atmospheric air without removing his/her mask. A snorkel can be used to breath while swimming at the surface, thus allowing the diver to continue to see underwater. Not only does this conserve air/gas, but the diver may have no air supply left with which to breathe. Being able to conveniently breathe atmospheric air at such times becomes of utmost importance.

Although the eye/nose mask and mouthpiece system is the preferred way to scuba dive at the present time, verbal communication cannot be practically accomplished when using it. The electronic/mechanical design and manufacture of wireless underwater communicators is now a practical matter and well within the financial feasibility of scuba divers. The breathing system mouthpiece prevents formation of words and there is no acoustic chamber into which to speak the words so that a microphone can pick up and transmit the signals to another diver or the surface.

Underwater, if the diver becomes lax and relaxes his teeth and lips, some water will leak into his/her mouth. If the diver becomes unconscious underwater, the mouthpiece will fall out. If the diver is unconscious or incoherent and loses his/her mouthpiece, another diver going to his/her aid cannot replace the mouthpiece and there is no way of connecting any other breathing device to the distressed diver. A spare emergency breathing device cannot be connected to the diver who is in need of breathing while underwater. The unconscious or incoherent diver must be taken to the surface or to an underwater air bubble station, e.g. diving bell, to continue his/her breathing or to attempt resuscitation. Since scuba divers very rarely utilize underwater diving bells, the surface is usually the only option.

Cold water diving poses its own problems. Cold water exposure of the lips and face area that is outside the half mask and diving suit of the scuba diver is uncomfortable and results in heat loss from the skin area around the mouthpiece. In very cold water, the diver's lips can lose their ability to retain the breathing system mouthpiece. Scuba diving in polluted water is also very dangerous to the diver using the eye/nose mask and mouthpiece system. Pollutants have full contact to the diver's lips and from there to the interior of the mouth.

Another system that can be used by scuba divers is called the full face mask system. The full face mask covers the diver's entire face from the forehead, around and down the outside of each eye to under the chin. In the past, the full face mask has been used primarily by umbilical equipped, surface supplied divers. With the advent of wireless underwater communication these masks are being used by scuba divers to meet their need for speech capability.

There are currently three types of underwater full face masks. The first is a full face mask with one chamber. The interior of the full face mask is open without divisions. The diver's eyes, nose and mouth are all in an undivided sealed interior of the mask. A few masks have breathing regulator systems that access the interior of the mask on the sides, but most designs of this type mask have the breathing system access the interior of the mask at a point just in front of the diver's mouth. A mouthpiece on the interior of the mask is sometimes used with a few of these types of masks.

The second type full face mask includes an eyes and nose chamber separate from the mouth chamber. The interior of this full face mask is thus divided into two separate chambers. The nose and the eyes are in a sealed upper cavity with a mask sealing lip running horizontally across the mask along the upper lip under the nose. The bottom cavity seals around the diver's mouth only. The breathing system is usually attached at the lower front of these masks. Some connect the breathing system at the lower sides. The nose is used to exhale air/gas into the upper chamber to equalize against increasing water pressure upon descent.

The third full face mask has an eyes chamber separate from a mouth/nose chamber. The interior of this full face mask is thus also divided into two separate cavities. The eyes are in one cavity and the nose and mouth are in another cavity. This type mask is sometimes called the "oral-nasal mask". The breathing system is usually connected to the mouth/nose chamber, although some masks flow the incoming breathing air across the viewing lens to prevent fogging, and then the breathing air flows into the mouth/nose chamber and to the diver.

The full face mask is used in scuba diving primarily to facilitate verbal, through water, wireless communications. There is also some use in very cold water, by divers who cannot hold a mouthpiece in place, by divers who dive in polluted water, and by divers who decompress in the water with oxygen as the breathing medium. Breathing oxygen underwater can cause convulsions and unconsciousness. If this happens when the diver is using a mouthpiece, the mouthpiece can be lost which can result in drowning.

An unconscious or incoherent diver is much safer in a full face mask. He/she can continue to breathe and the breathing system cannot be easily displaced. Another diver can assist the full face mask diver to breathe by pressing the purge button to inject breathing air and squeezing the unconscious diver to help him/her exhale. Also, the full face mask is held in place to the diver by a more secure head harness system that usually is comprised of five straps while the half mask uses only two straps.

Current full faced masks have some serious drawbacks, however. A back up breathing system that scuba divers are accustomed to and trained in, cannot be used with full face masks. Spare breathing systems cannot be easily used and buddy breathing cannot be done while wearing a full face mask. Removal of the full face mask creates more of a problem than leaving it in place. Loss of vision, and water up the nose are undesired complications to a situation where an alternate breathing system is needed. If the breathing system in the full face mask malfunctions or runs out of breathing air supply, the diver has no choice but to remove the mask to breathe at the surface, or underwater if an alternate breathing supply is at hand. Since the mouth is contained inside the full face mask, spare breathing systems that the scuba diver is trained in cannot be used. There are solutions to these problems but the solutions require additional hardware such as plugging in a breathing air source from another diver, or turning on a self contained emergency source if one is available.

Further the full face mask cannot be put on or removed while in the water at the surface or underwater in a convenient or comfortable way. Removal and replacement for training and confidence building can be done, but in normal operation this would not be desirable.

Another major drawback to scuba diving with many full face masks is that there is no way to breathe atmospheric air when the diver is at the surface. Hence, there is no way to save the self contained air supply prior to a dive. At times, the diver must swim some distance on the surface to the dive site after water entry. Many prior art full face masks require use of the air/gas supply because no practical method of breathing atmospheric air when in the water (at the surface) has been provided. Some masks allow an opening while the diver is not in the water, but these will not function when the diver enters the water. This results in the use of more air/gas at the start of the dive and the need to remove the full face mask if the air supply is exhausted at the end of the dive. Some prior art full face masks have been equipped with snorkels, but they did not function in a manner that was acceptable to the scuba diver. Those designs are no longer used.

International Publication WO 98/03225 discloses one attempt to provide a full face diving mask which includes a rigid frame 12 extending peripherally of the face of the user, a rigid viewing lens frame 22 and a removable mouth mask 30 to provide full access to the mouth of the user. The rigid frame 12 includes a continuous resilient seal member 18 engaging the peripheral surfaces of the facial surfaces of the user and a transverse seal 28 which defines an upper chamber 25 and a lower compartment 32. However, the seal member 18 is attached to the continuous rigid frame 12 which prevents the seal from conforming with substantial variations in head shape and facial contours of different users. Additionally, the mouth mask 30 is connected to the frame 12 by a pair of over center latches 46 which are somewhat difficult to manipulate in use.

As a result of the foregoing drawbacks in the full faced masks, the eye/nose masks or half mask and mouthpiece system that is in use by nearly all scuba divers today is the best system that is presently available to the scuba community, despite its own limitations. The full face mask has several desirable features that could improve scuba diving and make it more safe, but only if the negative aspects of the full face mask can be overcome.

The following patents illustrate other developments in the prior art of diving helmets and masks:

| | | | |
|---|---|---|---|
| 2,362,643 | 3,672,365 | 4,352,353 | 5,279,286 |
| 2,456,130 | 3,680,556 | 4,402,316 | 5,349,949 |
| 2,597,764 | 3,845,768 | 4,470,413 | 5,411,021 |
| 3,037,501 | 3,958,275 | 4,595,003 | 5,455,842 |

-continued

| | | | |
|---|---|---|---|
| 3,292,618 | 4,029,092 | 4,676,236 | GB 2 228 420 |
| 3,433,222 | 4,250,877 | 5,245,993 | WO 98/03225 |

The above prior art relates to various aspects of diving masks or helmets which have functioned satisfactorily. However, the present invention introduces features not found in the prior art including a flexible full face mask with structure enabling the mask to seal against the facial surfaces of different individual users regardless of normal variations in such facial surfaces. The present invention also provides for full access to the wearer's mouth without loss of vision underwater or in nonbreathable environments and thus maintains all of the advantages of the previously known half mask systems and full face mask systems without the drawbacks as discussed above.

SUMMARY OF THE INVENTION

The present invention relates to a flexible full face mask having separate rigid frames for the eyes, nose and/or mouth and chin which enables a wearer to maintain vision, breathing and communication in unbreathable environments including, but not limited to, underwater, atmospheres of noxious gases or where the normal amount of oxygen is not sufficient. The full face mask includes flexible structure enabling the mask to seal against each wearer's face regardless of conventional differences in facial surfaces. The mask also provides full access to the mouth and chin of the wearer when necessary or desirable, without having to remove the mask from the head of the wearer.

More particularly, the present invention includes a mask skirt in the form of a full face resilient, flexible one-piece face seal which is capable of sealing the mask against the face of individual users regardless of differences in the contour of the users' facial surfaces. In one preferred embodiment, the face seal extends across the upper forehead, around the outside of the eyes, under the nose and sealingly engages the upper lip to define an upper chamber or cavity. The face seal continues around the chin and includes a curved portion conforming to the chin surface and an upper flange edge in sealing engagement with the lower lip to define a lower chamber or cavity.

Mounted on the flexible seal in front of the wearer's mouth is a separate rigid frame oriented peripherally of the mouth and chin seal which forms the lower chamber or cavity aligned with the mouth of the wearer. Mounted on the flexible seal in front of the wearer's eyes is a separate rigid frame supporting a lens which forms the upper chamber or cavity aligned with the eyes of the wearer. The face seal structure in combination with the separable rigid frames thus define self-contained sealed spaces which can individually adjust and seal each self-contained space of the face seal to the contours of the facial surfaces of different wearers.

A removable adaptor pod is mounted on the front of the rigid frame of the lower chamber or cavity. The adaptor pod forms a water-tight sealed closure for the lower cavity and covers the mouth including the front, side and bottom. When the removable adaptor pod is mounted on the lower rigid frame, the mask is a full face mask. When the adaptor pod is removed, full access is provided through the lower cavity, and the mask then functions as a half mask or scuba mask. The adaptor pod can be removed when the mask is on the wearer and replaced without the use of tools. This allows an unconscious wearer to be administered cardio pulmonary resuscitation (CPR) without removing the mask and enables the breathing passage of a wearer to be cleared for rapid use of equipment to resuscitate a victim if necessary. The adaptor pod can be made in various configurations to accommodate different breathing devices as well as oral communication equipment.

It is therefore an object of the present invention to provide a full face mask that can be comfortably worn by wearers having different facial contours in order to see, breathe, and communicate in unbreathable environments, such as underwater, in atmospheres of noxious gases, or where the normal amount of oxygen is not sufficient.

Another object of the present invention is to provide a flexible full face mask having separate compartments for the eyes, nose and/or mouth that allows full access to the wearer's mouth and chin for things such as, but not limited to, for above surface breathing before or after underwater diving and for emergency breathing apparatus or for clearing the breathing passageway in an unconscious victim.

A further object of the present invention is to provide a full face mask having a specially shaped one-piece face seal that has self-contained sealed spaces molded into the face seal that can individually adjust and seal each self-contained space of the mask to the wearer's face. The mask can be configured into several self-contained spaces (eyes, nose, and mouth). For example, a two self-contained space full face mask can have an eye and nose space with an upper lip seal separating it from the lower space that covers the mouth and chin. Both self-contained spaces would be connected by a specially shaped and designed areas in the resilient flexible face seal called adjustment zones to form a single face seal that allows each self-contained space to individually contour and seal on the wearer's face.

A still further object of the present invention is to provide a full face mask having rigid components forming mounting areas that are semi-permanently attached to the flexible face seal which help make up the self-contained spaces. These rigid mounting areas can receive different adaptors like viewing lenses, breathing adaptors, head harness placement or accessory adaptors, e.g. for communications, drinking tubes, sensors, etc. The lower rigid mounting area of the full face mask is designed and shaped in such a manner that it allows full access to the wearer's mouth and chin. The rigid mounting areas are equipped with special hooks and latches that allow for removal and replacement of an adaptor pod being mounted to that area or self-contained space. These hooks and latches allow this to be done by hand, without the use of tools and while the full face mask is in use on the wearer's face. For example, a breathing adaptor pod can be quickly and easily removed and replaced on the mask as needed by the wearer.

Yet another object of the present invention is to provide a full face mask that can be configured in several different ways. Two, three and four self-contained space full face masks can be created with the full face mask design of the present invention. Some of the possible, but not all of the configurations are as follows: An example of a two self-contained space full face mask would be a mask that has a self-contained space for the user's eyes and nose and another self-contained space for the mouth and chin, both of these self-contained spaces are connected together using a special adjustment zone or zones that create a single face seal design that allows each self-contained space to individually contour and seal against the wearer's face. Another example of a two self-contained space full face mask would be one where the eyes are in one self-contained space and the nose, mouth and chin are in another self-contained space connected together by the adjustment zone or zones. A three self-contained space full face mask would have a self-contained space for the eyes, a self-contained space for the nose and a self-contained space for the mouth and chin all connected together by the adjustment zones. A four self-contained space full face mask would have each eye in its own self-contained space, the nose in a self-contained space and the mouth and chin in a self-contained space. All of these self-contained spaces are connected together by the adjustment zones to create a single face seal design full face mask.

Still another object of the invention is to provide a full face mask in which the face seal is made from a soft flexible substance like natural or synthetic rubber, urethane, or silicone rubber. Rigid components are semi-permanently fastened to the soft face seal that have replaceable adaptors that help create the self-contained spaces. Each self-contained space is sealed from the environment that is on the outside of the full face mask and the adjoining self-contained spaces. The face seal is designed in such a manner that each self-contained space of the face seal is specifically shaped to fit and conform to the appropriate mating facial features that it is intended to seal against. Included in each of the self-contained spaces are smaller thin, flexible, resilient flaps (1/8"–1/2") that are molded into the outer edge of the self-contained space seal, some of them facing in, some of them facing out, that allow that specific self-contained space to correctly seal and conform to the wearer's face. These small flaps also aid the full face mask to conform and seal during the natural over and under pressures that are experienced during normal use of the full face mask. The self-contained spaces are allowed to extend past adjustment zones and onto the side of the face. This allows each of the self-contained spaces to have its own shape and correct width, height and depth for sealing that specific self-contained space.

An additional object of the present invention is to provide a full face mask in which adjustment zones are molded into the face seal and take the form of thinner and thicker specially shaped sections of the face seal that either act as a pivot point or as a stretchable adjustment zone of the mask. The adjustment zones connect the self-contained spaces together and aid each one of the self-contained spaces to conform to and individually seal onto the contours of the wearer's face. The adjustment zones also seal against the face protecting it from contaminates in the areas that they cover. Since the self-contained spaces need to seal against different people at different angles the adjustment zones allow each one of the self-contained spaces to assume the correct sealing angle for that specific self-contained space.

The adjustment zones are shaped in such a manner as to allow the outer edges of the self-contained spaces to extend out and onto the face correctly sealing each of the self-contained spaces. This creates what is called a scalloped face seal. When viewing the full face mask from a side view the outer edge of the face seal turns in and out creating a "scalloped shape". This scalloped shape allows each of the self-contained spaces to individually assume its correct position (depth, width, and height) on the face. As the adjustment zones pivot and stretch they aid the fit and seal of the joined self-contained spaces by pulling on the outer edge of the seal portion of the self-contained spaces that are allowed to extend past the adjustment zones, pulling them towards the face creating a better seal and covering more face sizes. As the face goes into the full face mask, and because of where the adjustment zones have been placed and how they have been shaped, the adjustment zones stretch pulling either at the top or the bottom of a self-contained space causing the sides to move inward for better sealing on the face.

Another additional object of the invention is to provide a full face mask in which rigid components that are attached to the face seal allow different adaptors or adaptor pods to be mounted to them. These adaptors can come in the form of viewing lenses, breathing systems, or other accessories. The lower adaptor pod (usually a breathing/communications adaptor) is easily removed and replaced, by hand, without the use of tools, while the full face mask is in use on the wearer's face, allowing full access to the user's mouth and chin. Hence, the mask of the present invention can be used for scuba diving. The training agencies of the scuba industry have taught scuba divers to address emergency situations using specific procedures, techniques and equipment. The present invention allows the scuba diver to use all of these traditional procedures, techniques and equipment.

The lower removable adaptor also allows access to the mouth and chin, that can be used with all configurations of the full face mask. For situations out of the water, this allows CPR (Cardiopulmonary Resuscitation) to be administered to an unconscious victim without removing the mask. The lower adaptor pod can be removed on an unconscious victim, the breathing passage can be cleared, then either a special breathing adaptor pod or special equipment or techniques can be used to resuscitate the victim. One of the basic steps of the emergency CPR procedures that is usually taught is to "clear the passageway". This insures that there is nothing obstructing the breathing passage (foreign object, tongue, vomit, etc.) before the resuscitation begins. It is usually done by rolling the victim's head to the side, grabbing the chin and opening the victim's mouth, then visually determining if any obstructions exist and, if so, using a finger to try and sweep the obstruction out. The removable adaptor pod of the present invention allows full access to the mouth and chin so that this part of the CPR procedure can be done without removing the mask. These procedures can be done while the mask remains on the victim minimizing and controlling the exposure to the contaminated surrounding environment. The full face mask can be configured so that a person wearing the mask can administer CPR to a victim that is also wearing a similar mask. By removing both lower adaptor pods, the one on the rescuer and on the victim's mask, CPR can be performed. Basically, when correctly configured, people wearing a full face mask of the present invention with the lower adaptor pods removed, have the ability to touch lips.

Yet a further object of the present invention is to provide a full face mask in which a lower chamber of the mask seals around the mouth, but includes an adaptor pod that can be removed to enable unimpeded access to the mouth thereby enabling the wearer to breathe, orally communicate, eat or drink and perform other normal oral activities when not underwater or not in a nonbreathable environment.

A still further object of the present invention is to provide a full face mask which includes a full face seal capable of remaining in place on the wearer's face and a removable adaptor pod which can be replaced with other adaptor pods fitted with various other devices or systems to be sealingly attached to the face seal without removing the face seal from the wearer's face.

A final object of the present invention is to provide a full face mask in accordance with the preceding objects which includes a mouth adaptor pod aligned with the mouth that can be removed in an emergency situation so that an emergency breathing system can be used in association with the mouth or the breathing passage of the wearer can be cleared without removing the full face mask from the wearer's face.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
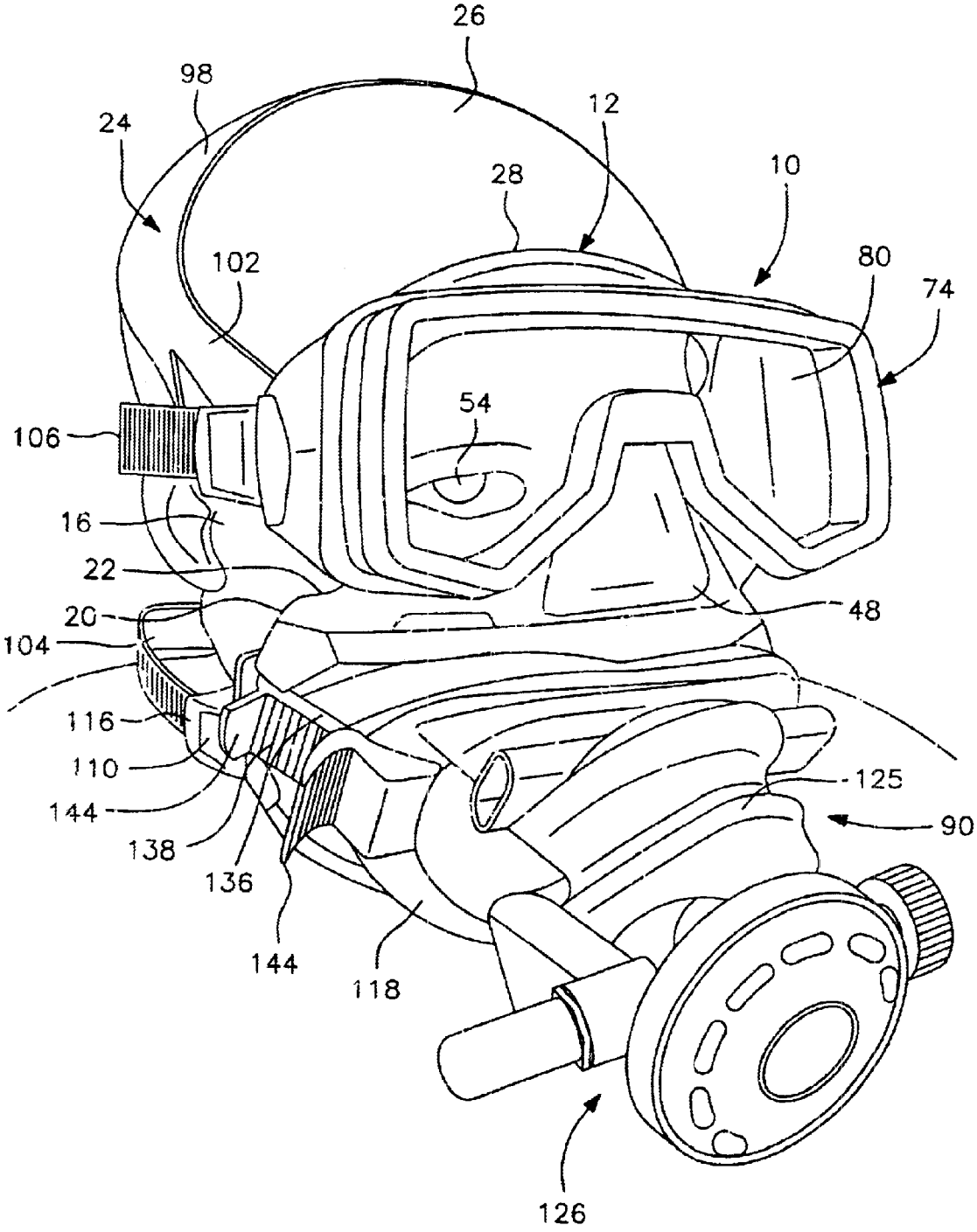
FIG. 1 is a front perspective view of one preferred embodiment of a full face mask according to the present invention, illustrating the removable mouth adaptor pod installed in its normal sealed relation to a lower rigid frame.

Although several preferred embodiments of the present invention are explained in detail, it is to be understood that these embodiments are given by way of illustration only. It is not intended that the invention be limited in its scope to the specific details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

The full face mask of the present invention as illustrated in FIG. 1 is generally designated by reference numeral 10 and includes a one-piece mask skirt generally designated by reference numeral 12 constructed of resilient, flexible material which forms a full face seal. The mask skirt or full face seal 12 comprises an upper portion generally designated by reference numeral 15 and a lower portion generally designated by reference number 17. The upper portion 15 and lower portion 17 are separated by indentations or inwardly curved areas 22 in side edges 20 to define flexible and stretchable resilient adjustment zones 23 (AZ) as indicated in FIGS. 3, 4, 8 and 9–12.

The mask skirt or full face seal 12 extends across the forehead at 14, downwardly along the sides of the face at 16 and under the chin area at 18, of the wearer. The mask skirt or full face seal 12 is formed as one piece and is constructed of molded resilient flexible material such as natural or synthetic rubber, urethane, silicone rubber or the like which allows the seal to readily flex and fit to different facial contours. The inwardly extending curved areas 22 in the central area of side edges 20 form so-called "scalloped" side edges, as illustrated in FIGS. 3, 4 and 8.

Figure 2:
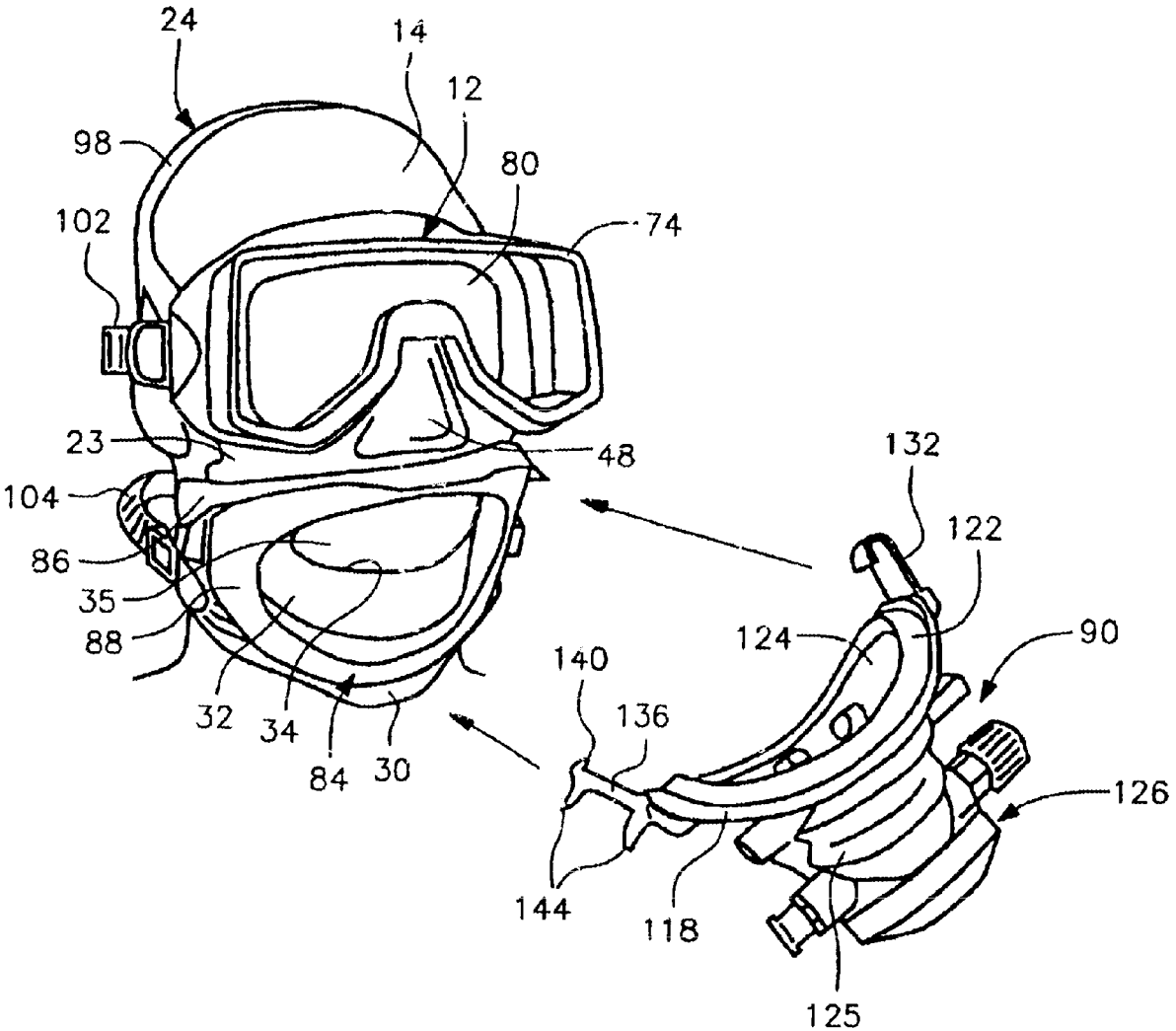
FIG. 2 is a view similar to FIG. 1 but illustrating the mouth adaptor pod separated from the full face mask of FIG. 1 to provide free access to the mouth and chin of the wearer.
Figure 3:
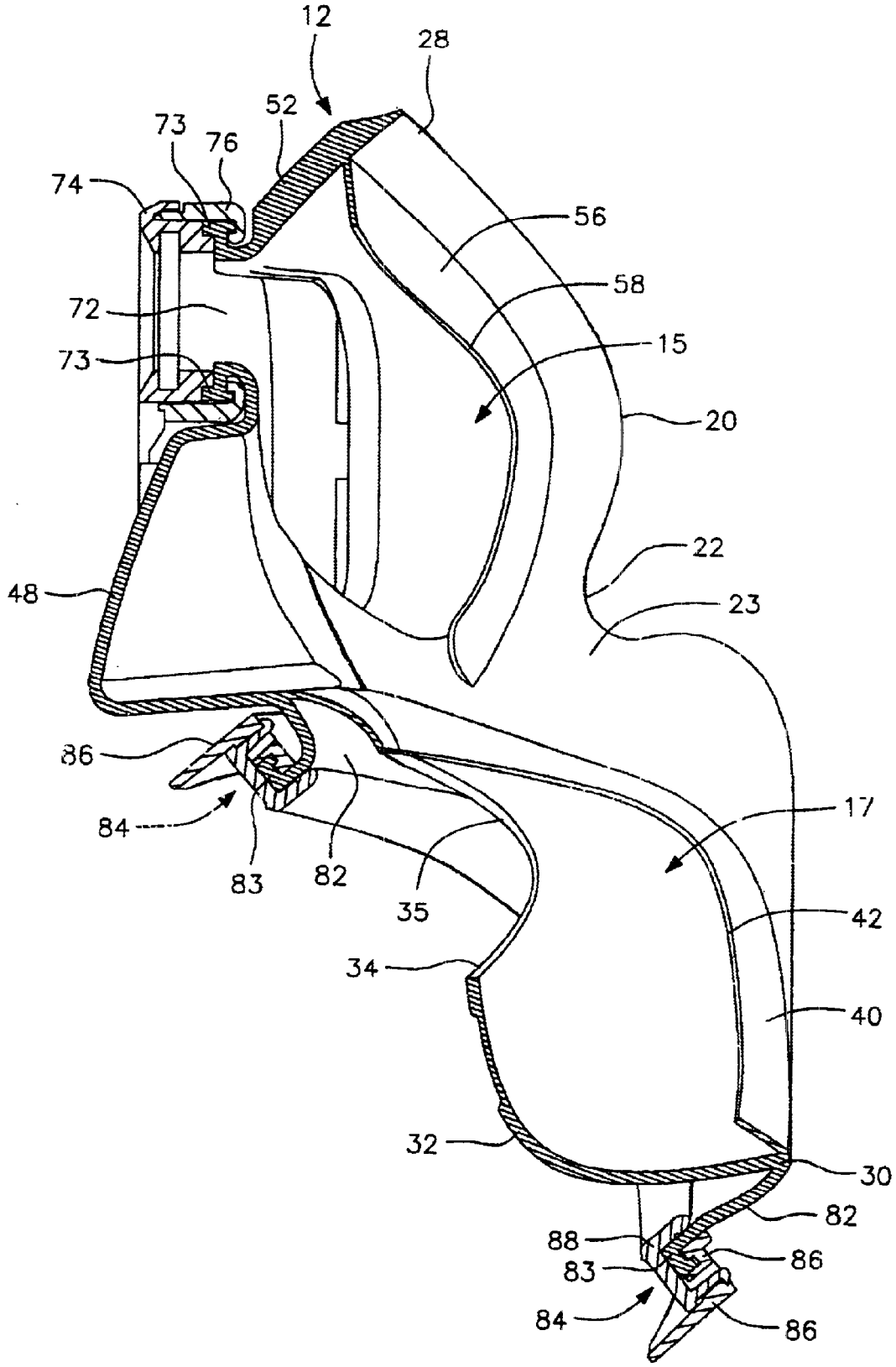
FIG. 3 is a vertical sectional view of the full face mask of FIG. 1 with the removable mouth adaptor pod removed illustrating the relationship of the rigid frame to the mask skirt.
Figure 4:
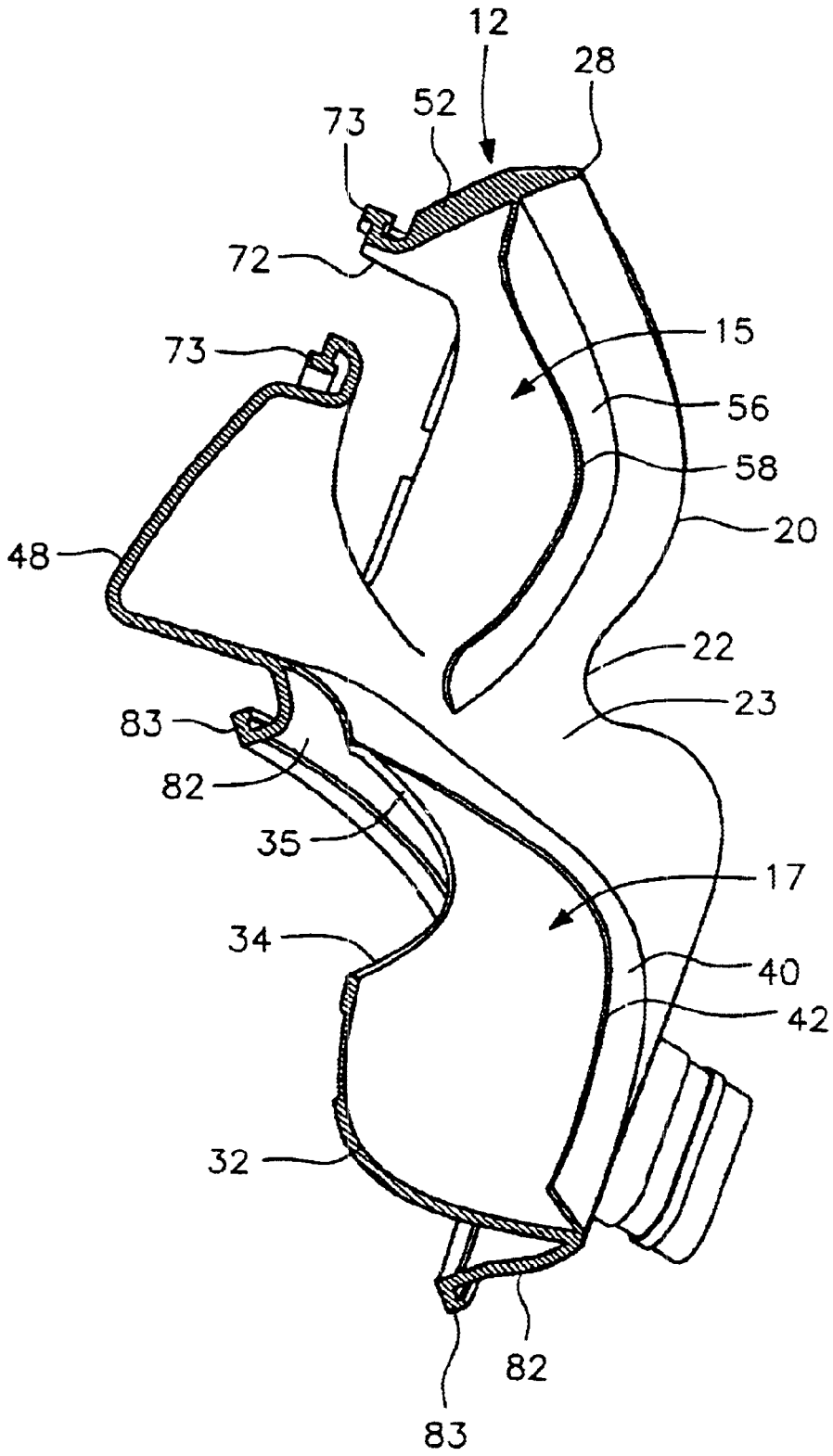
FIG. 4 is a vertical sectional view of the full face mask skirt of the present invention with the frames omitted.
Figure 7:
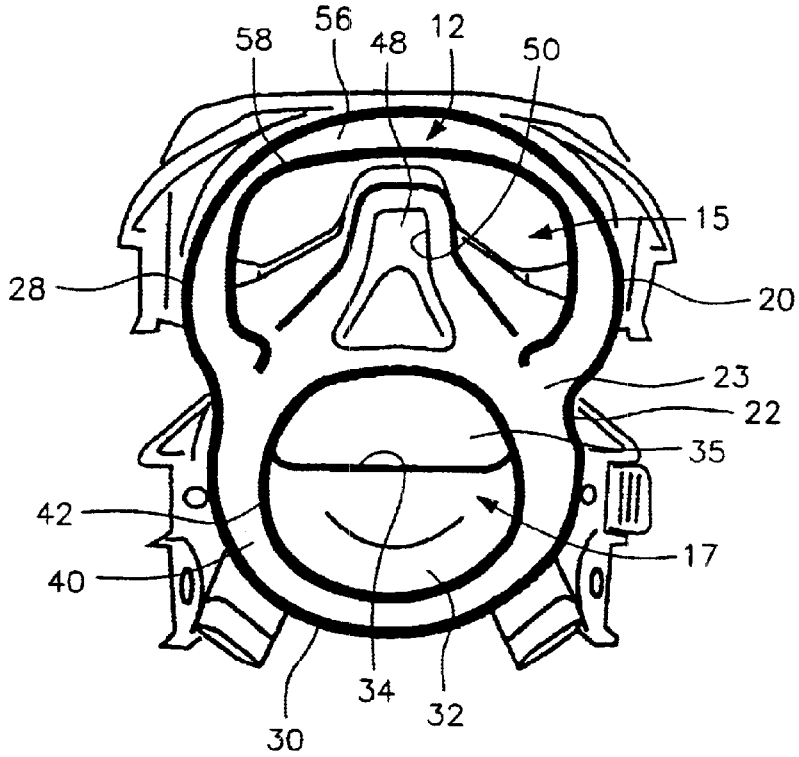
FIG. 7 is a schematic rear elevational view of the mask illustrated in FIG. 1, showing the orientation and configuration of a full face seal formed by the mask skirt.

FIGS. 3 and 7 illustrate the rear edge 28 of the full face seal 12 which is continuous across the forehead 14 with side edges 20 extending downwardly along the side surface of the face. The side edges 20 then extend downwardly and under the chin 18 in a curved lower edge portion 30. The lower curved portion 30 of the rear edge of the full face seal 12 includes a flexible, resilient forwardly extending cup shaped member 32 which conforms with and engages the chin area 18 of the user. The curved lower portion 30 also includes a curved upper edge 34 engaging the chin below the lower lip 38 of the mouth 37 of the wearer as illustrated in FIGS. 2, 3 and 8.

The lower portion 30 of the full face seal 12 includes a continuous flexible inwardly and forwardly extending resilient flap 40 terminating in a thin, flexible resilient inner edge 42. The inner edge 42 extends under the chin 18, upwardly along the areas of the face outwardly of the mouth 37, along the upper lip 44 of the mouth 37 and below the nose 46, of the wearer. The inner edge 42 of the flap 40 is continuous throughout its extent with the thin flexible inner edge 42 being spaced from the cup shaped member 32. The cup shaped member 32 includes upper side edges which join with the full face seal 12 between the portion of flap 40 which engages the upper lip 44 and the portion of the full face seal which forms a resilient flexible nose receiving projection 48. The curved upper edge 34 of cup shaped member 32 is spaced below the edge 42 of the portion of flap 40 which engages the upper lip 44 to form an opening 35 to provide full access to mouth 37.

Figure 8:
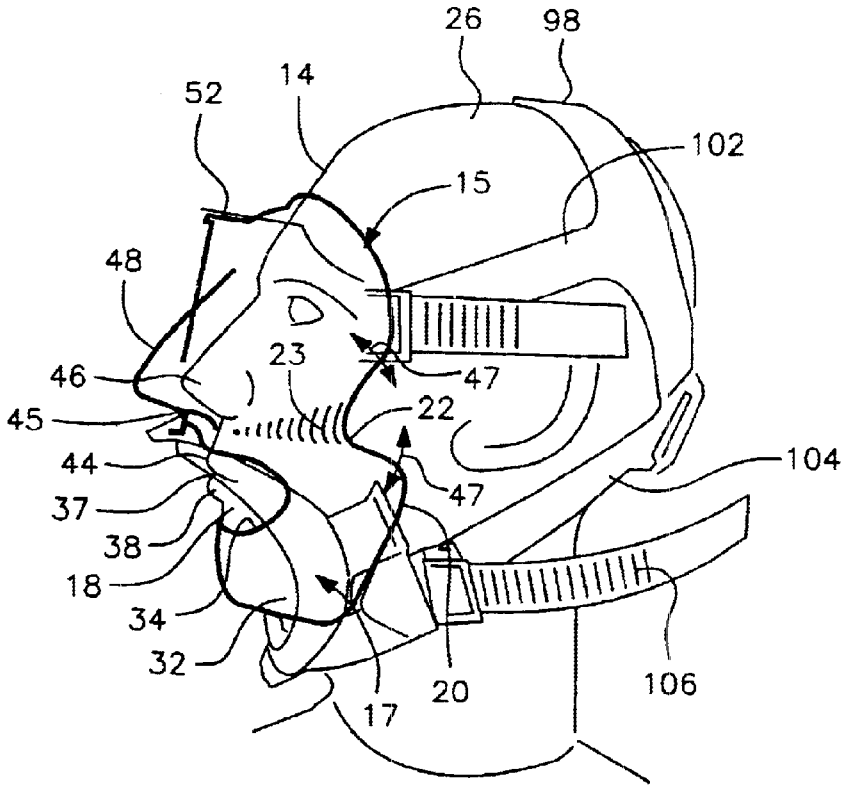
FIG. 8 is a schematic side elevational view of the mask of FIG. 1, illustrating the relationship of the mask skirt to the face of a wearer and illustrating the adjustment zones to enable upper and lower components of the full face mask skirt to pivot and stretch to conform with the contours of the face of the wearer to maintain a full face seal.

A cavity 50 is provided in the inner surface of the full face seal 12 corresponding to projection 48 to receive nose 46 as illustrated in FIGS. 3 and 8. As illustrated in FIG. 3, the top of the full face seal 12 includes a relatively wide area 52 which extends downwardly on opposite sides of the eyes 54 of the wearer. The wide area 52 extends into the inwardly curved scalloped edges 22 which form the adjustment zones 23 on each side of the full face seal 12. This configuration enables the upper portion 15 of the full face seal 12 to pivot in relation to the lower portion 17 generally in an area 45 between the nose 46 and upper lip 44 of the wearer so that the upper portion 15 and the lower portion 17, can more closely fit the contour of the face of different users. The thickness of the adjustment zones 23, indicated by AZ in some figures, is less than the other peripheral portions of the resilient full face seal 12. This reduced thickness facilitates the pivotal movement between the upper portion 15 and lower portion 17 and also enables stretching in the zones 23. The stretching and pivoting in the adjustment zones 23 permit the resilient full face seal 12 to conform with the various contours of human faces.

FIG. 8 illustrates schematically the location of the pivot point 45 and schematically illustrates, by arrow 47, the angular adjustment provided by the adjustment zones 23 on each side of the mask. The resilient flexibility of the adjustment zones 23 allows for the angular adjustment between the upper portion 15 and lower portion 17.

The upper portion 15 of the full face seal 12 engages the forehead 14 and includes an inclined thin, flexible flap 56 as illustrated in FIG. 3. The flap 56 includes a thin and very flexible inner edge 58 which extends downwardly and merges with the area of the full face seal 12 that covers the nose 46. The inner edge 58 cooperates with the inner surface of the nose receiving projection 48 and the edge 42 of flap 40 to provide a continuous sealing engagement with the area of the face across the forehead, downwardly alongside eyes 54 and inwardly toward the nose 46. The edge 42 of the flap 40 then cooperates with these components to provide a continuous seal peripherally of the face and chin.

The lower portion of the full face seal 12 includes a resilient peripheral flange 82 defining the opening 35 in the area which includes the cup shaped member 32, flap 40 and lower seal edge 30. The periphery of resilient flange 82 includes a hook shaped edge or lip 83 as shown in FIGS. 3 and 4. A rigid peripheral frame structure, generally designated by reference numeral 84, is mounted onto the resilient peripheral flange 82 and includes a jaw frame 86 and a jaw frame retainer 88. The jaw frame 86 and jaw frame retainer 88 are provided with recesses shaped to receive lip 83 on resilient flange 82 and are secured together with the lip 83 on the peripheral edge of the flexible flange 82 secured between the rigid jaw frame 86 and frame retainer 88 thus securing the rigid frame 84 to the full face seal 12 as shown in FIG. 3.

The lower portion of the full face seal 12 includes a resilient peripheral flange 82 defining the opening 35 in the area which includes the cup shaped member 32, flange 40 and lower seal edge 30. The periphery of resilient flange 82 includes a hook shaped edge or lip 83 as shown in FIGS. 3 and 4. A rigid peripheral frame structure, generally designated by reference numeral 84, is mounted onto the resilient peripheral flange 82 and includes a jaw frame 86 and a jaw frame retainer 88. The jaw frame 86 and jaw frame retainer 88 are provided with recesses shaped to receive lip 83 on resilient flange 82 and are secured together with the lip 83 on the peripheral edge of the flexible flange 82 secured between the rigid jaw frame 86 and frame retainer 88 thus securing the rigid frame 84 to the full face seal 12 as shown in FIG. 3.

A removable mouth adaptor pod 90 including appropriate breathing apparatus is detachably connected to the outer rigid frame retainer 88. A harness, generally designated by reference numeral 24, is adjustably connected to the sides of the rigid eye lens body 74 and the sides of the rigid frame structure 84 as illustrated in FIG. 2, in order to hold the mask 10 on the head 26 of the wearer.

The harness 24 includes a flexible annular member 98 having a separable connector 100 at a lower portion thereof when the annular member 98 is engaged with the rear portion of the head 26 of the user. The connector 100 is preferably a squeeze type connector located generally at the base of the skull of the user. The annular member 98 includes upper and lower straps 102 and 104 on each side thereof which extend forwardly adjacent the eye level and adjacent the bottom of the chin area. The inner surface of each of the straps 102 and 104 is corrugated or provided with transverse ribs as indicated by reference numeral 106. The free ends of the straps 102 and 104 extend through adjustable connectors 110 on opposite ends of the eye lens body 74 and connectors 110 on opposite sides of rigid jaw frame structure 84, respectively. This enables adjustment of the effective length of the straps in a manner well known with the connector 100 enabling separation of the harness for removal of the mask from the head 26 of the wearer. A flexible tubular sleeve 112 having opening areas 114 in opposite portions thereof may be used to provide a cushion and protection for the connector 100.

As illustrated, the straps 102 and 104 have the serrations or ridges 106 on the inner surface thereof and each of the connectors 110 include a passageway 113 therethrough with the free end of the strap extending outwardly through the passageway 113 and rearwardly under a pivotal latch 115. The latch 115 is constructed with a rib 116 to engage the ribs or serrations 106 on straps 102 and 104 thereby allowing the straps to be pulled through the passageways 113 to tighten the harness without any manipulation of the connectors. However, when it is desired to pull the straps back through the connectors, it is necessary to pivot the latch 115 outwardly in order to release the straps 102 and 104 for movement toward a loosened position when placing the mask on the head or removing it.

Figure 5:
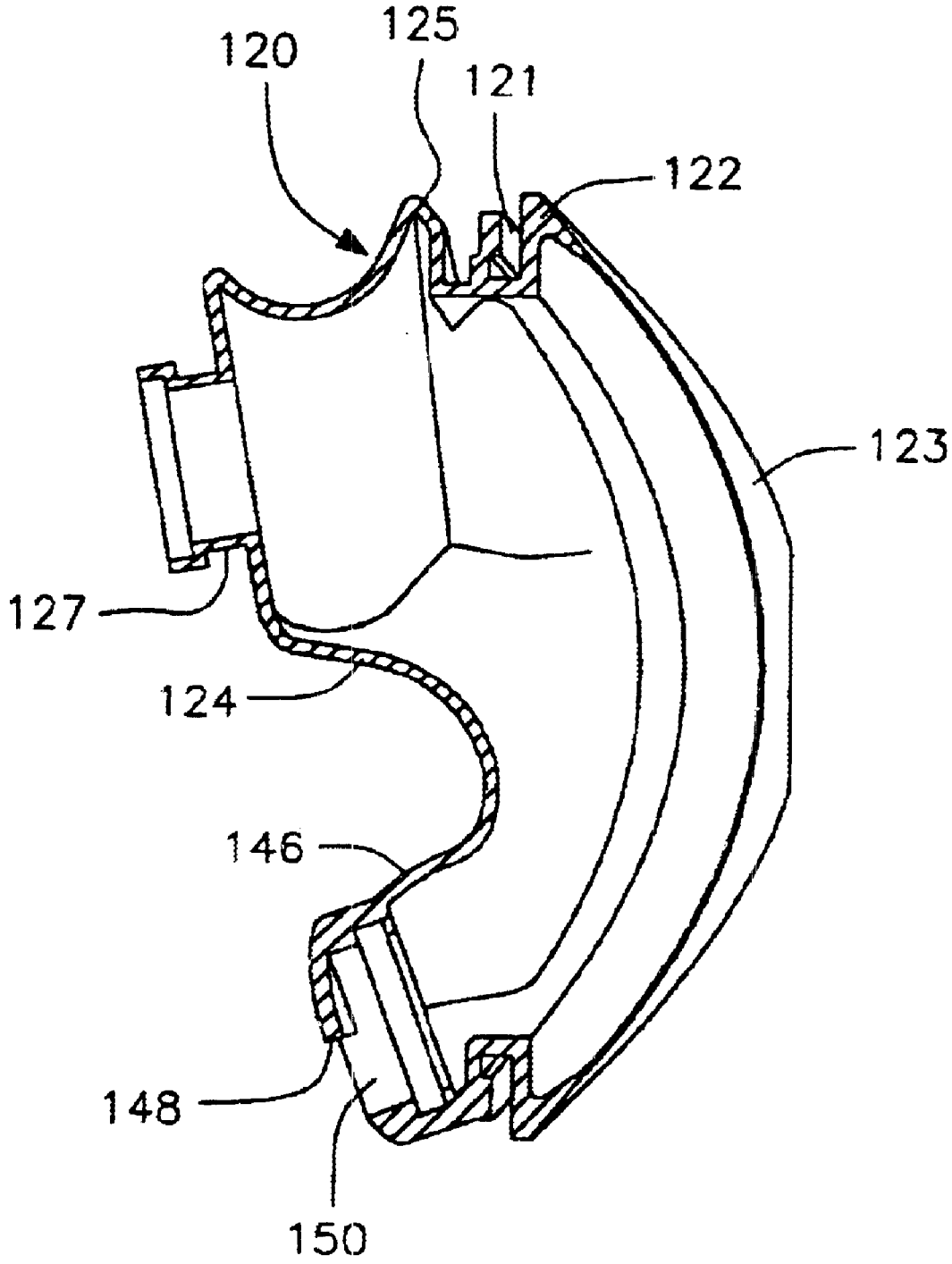
FIG. 5 is a vertical sectional view of the molded resilient flexible cover for the removable mouth adaptor pod for the full face mask of FIG. 1.
Figure 6:
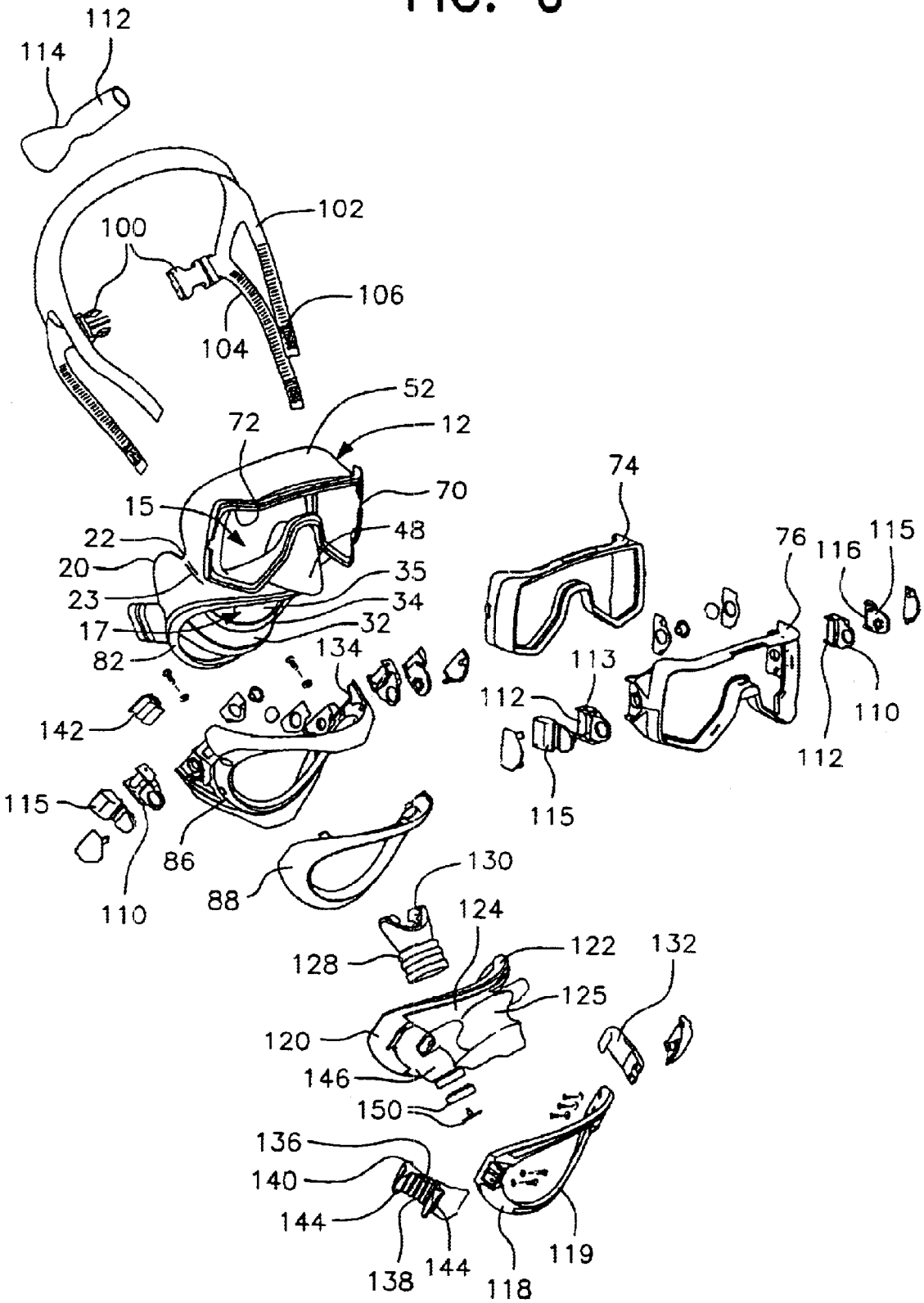
FIG. 6 is an exploded group perspective view of the components of the full face mask of FIG. 1.

The removable mouth adaptor pod 90 includes a rigid external frame 118 that is oval shaped and arcuately curved from end to end to fit around and be attached to an inner edge of a flexible cover 120, both of which are configured to fit against the rigid frame structure 84. The inner edge of the resilient cover 120 includes a peripheral groove 121 which receives the inner peripheral edge 119 of rigid frame 118. The groove 121 has one surface formed by a flap seal 122 that extends inwardly in overlying relation to the inner surface of frame 118 to a thin resilient edge 123 for sealing engagement with the rigid frame structure 84, as illustrated in FIGS. 5 and 6. The cover 120 includes a central resilient flexible member 124 forming a closure for frame 118 and an outwardly extending bellows portion 125 at its upper end portion to which a breathing apparatus 126 can be connected. The bellows portion 125 thus enables flexible movement between the breathing apparatus 126 and the rigid frame 118.

The bellows portion 125 includes a forwardly projecting tubular sleeve 127 which is connected to the breathing apparatus 126 and receives a tubular mouthpiece 128 connected to the breathing apparatus 126. The mouthpiece 128 is flexible and resilient and includes bits 130 to enable the wearer to retain the mouthpiece gripped between the teeth in a known manner. The resilient flexible cover 120 also includes an outwardly extending lower portion 146 having an opening 148 in which a purge valve 150 may be mounted.

In order to removably mount the mouth adaptor pod 90 on the frame structure 84, one end of the rigid frame 118 is provided with a hook shaped member 132 which engages with a notched edge at 134 on the mating side of the rigid frame member 86. The other end of frame 118 has a catch 136 mounted thereon. The catch 136 is preferably in the form of a substantially rigid strap constructed of plastic or other suitable material in which the surfaces are serrated or grooved at 138 and provided with an inturned hook 140 at the free end thereof. The inturned hook 140 lockingly engages one of a plurality of sloped serrations or notches 142 on the other side of the rigid frame member 86 when the sealing flap 122 comes into sealing engagement with the rigid frame structure 84. The catch 136 also includes a pair of projecting tabs or handles 144 adjacent opposite ends thereof. The limited flexibility of the strap forming the catch 136 enables the tabs 144 to be squeezed toward each other sufficiently to move the hook 140 out of engagement with the serrations or notches 142. The hook member 132 and the catch 136 mounted on the rigid frame 118 enables the mouth adaptor pod 90 to be easily mounted on and released from rigid peripheral frame structure 84 on the lower portion 17 of the full face seal 12.

Figure 9:
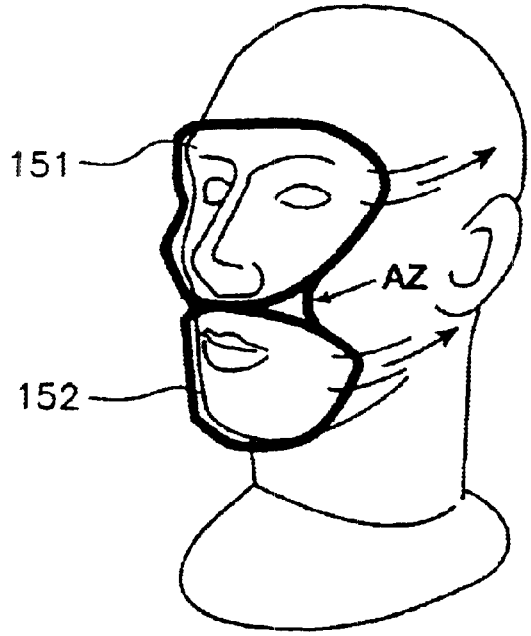
FIG. 9 is a schematic perspective view illustrating the FIG. 1 embodiment of the one-piece face seal of the present invention, sealing one self-contained space containing the eyes and nose and a second self-contained space containing the mouth.
Figure 10:
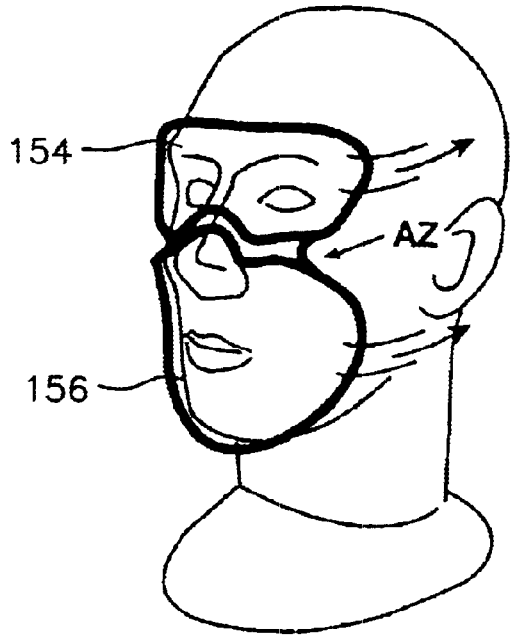
FIG. 10 is a schematic perspective view illustrating another embodiment of the one-piece face seal of the present invention, sealing an upper self-contained space containing only the eyes and a lower self-contained space containing the nose and mouth.
Figure 11:
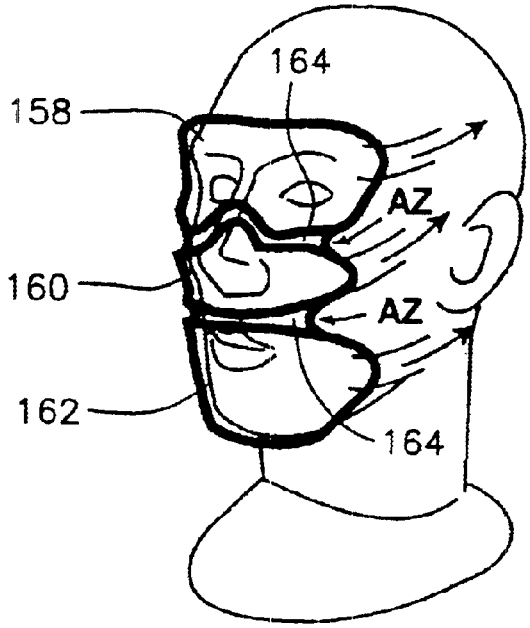
FIG. 11 is a schematic perspective view illustrating yet a further embodiment of the one-piece face seal of the present invention, sealing three self-contained spaces including an upper space for the eyes, an intermediate space for the nose and a lower space for the mouth.
Figure 12:
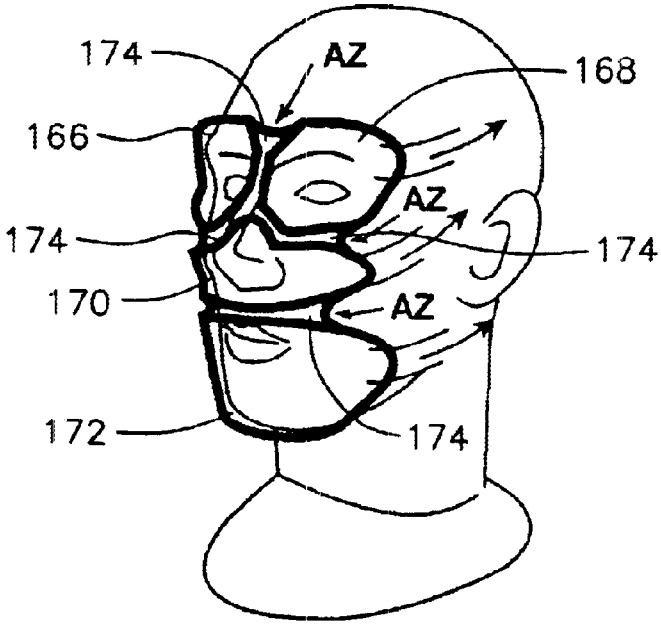
FIG. 12 is a schematic perspective view illustrating still another embodiment of the one-piece face seal of the present invention, sealing four self-contained spaces with one space for sealing one eye, a second space sealing the other eye, a third space sealing the nose and a fourth space sealing the mouth.
Figure 6:
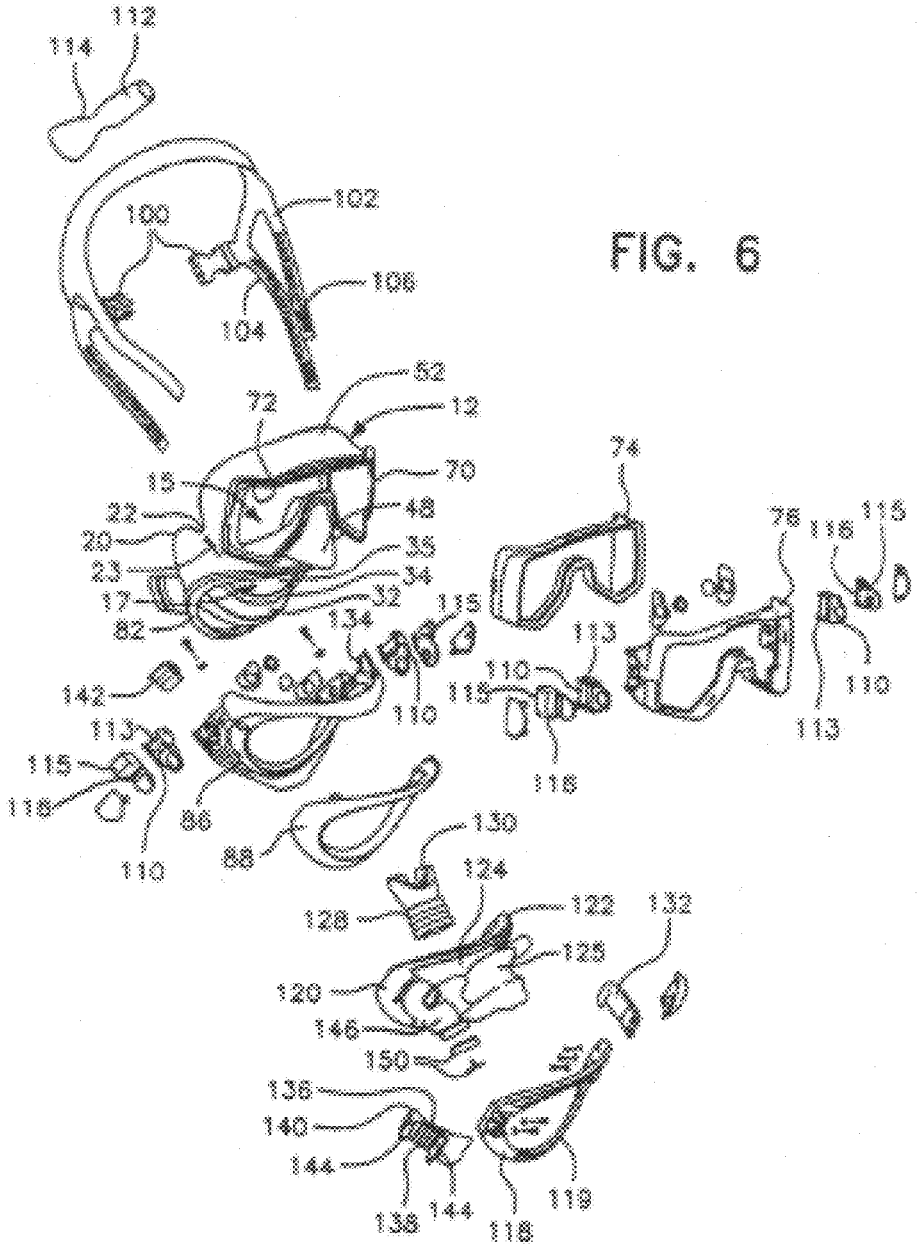

FIGS. 1–8 disclose an embodiment of the invention in which two self-contained spaces are defined with the full face seal 12 having an adjustment zone 23 between the two spaces to enable adjustment of the sealed spaces to fit the contour of the wearer's face. As illustrated in FIG. 9, the upper self-contained sealed space 151 encloses the eyes and nose of the user and the lower sealed self-contained space 152 covers the mouth of the user. In FIG. 10, the upper sealed self-contained space 154 covers only the eyes of the user and the lower self-contained sealed space 156 covers the nose and mouth of the user. In FIG. 11, three separate self-contained sealed spaces are illustrated with the upper space 158 covering the eyes, the middle space 160 covering only the nose and the lower space 162 covering the mouth. In this embodiment of the invention, an adjustment zone 164 (AZ) is provided between each adjacent self-contained sealed space. In FIG. 12, four sealed self-contained spaces are provided with two separate upper sealed self-contained spaces 166 and 168 provided with one covering one eye and one covering the other eye. An intermediate sealed self-contained space 170 covers only the nose and a lower self-contained space 172 covers only the mouth. Adjustment zones 174 (AZ) are provided between the two eye covering spaces and between the two eye covering spaces and the intermediate space and between the intermediate space and the lower self-contained space.

The adjustment zones enable each of the separate, sealed self-contained spaces to be adjusted or moved by exerting forces thereon. The forces can serve to pivot the spaces in relation to each other and to move the spaces in relation to each other by stretching the adjustment zones. The forces can also cause the full face seal 12 to stretch by exerting tension on the opposite ends or tension on the opposite sides. Further, twisting movements and the like enable the full face seal 12 to vary its contour to adapt it to the surface contours of the facial areas to be sealingly engaged by the full face seal which defines the separate self-contained spaces.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A full face mask comprising a full face seal for sealing engagement with a peripheral surface of a face of a user, said full face seal being constructed of flexible, resilient material for sealing engagement with said peripheral surface and including at least upper and lower separate self-contained sealed spaces and flexible, resilient adjustment zones formed in said full face seal between said upper and lower separate self-contained sealed spaces to enable the self-contained spaces to individually seal against said peripheral surface of a face of a user, each of said upper and lower separate self-contained sealed spaces including a separate rigid frame, at least one of said rigid frames providing a mounting area for an adaptor to be mounted on said rigid frame.

2. The full face mask as defined in claim 1, wherein the lower of said self-contained spaces is adapted to be aligned with a mouth and chin of a user, said full face seal and said rigid frame connected to said lower of said self contained spaces being shaped to provide full access to a mouth and chin of a user when said adaptor connected to said lower of said spaces is removed.

3. The full face mask as defined in claim 1, wherein said adaptor includes detachable connections that permit different adaptors to be quickly and easily manually removed and replaced by hand while the mask is being worn by a user to sealingly connect an adaptor to said rigid frame.

4. The full face mask as defined in claim 1, wherein said full face seal includes a head harness attached thereto by adjustable fastening means for pulling the upper and lower self-contained sealed spaces toward said peripheral surface of a face of a user for sealing the self-contained spaces to said peripheral surface of the face of a user.

5. The full face mask as defined in claim 1, wherein said full face seal includes a peripheral inwardly extending, inclined flap having a thin, flexible inner edge for sealing contact with facial surfaces of a user engaged by the full face seal.

6. The full face mask as defined in claim 1 wherein said upper self-contained sealed space defines a space for covering a user's eyes and nose, said lower self contained sealed space covering only a mouth and chin of a user, said adjustment zones between said upper and lower spaces of flexible resilient material enabling relative movement between said upper and lower self contained sealed spaces.

7. The full face mask as defined in claim 1, wherein said upper self-contained sealed space is adapted to cover only a user's eyes and said lower self-contained space is adapted to cover a mouth and nose of a user, said adjustment zones between said upper and lower self-contained spaces enabling relative movement therebetween.

8. The full face mask as defined in claim 1, wherein said upper space is adapted to cover only a user's eyes, said full face seal including an intermediate space adapted to cover only a nose of a user, said lower space is adapted to cover only a mouth of a user, said flexible resilient adjustment zones including a flexible resilient adjustment zone interconnecting said upper space and said intermediate space and a flexible resilient adjustment zone interconnecting said intermediate space and said lower space.

9. The full face mask as defined in claim 1, wherein said upper self contained sealed space includes an upper right space adapted to cover only a right eye of a user, an upper left space adapted to cover only a left eye of a user, said full face seal including an intermediate space adapted to cover only a nose of a user, said lower self contained sealed space adapted to cover only a mouth of a user, said adjustment zones including an adjustment zone connecting said upper left and upper right spaces to each other and to said intermediate space and a resilient flexible adjustment zone interconnecting said intermediate space and said lower space to enable relative movement between all of the self-contained spaces.

10. A full face mask comprising an upper rigid frame adapted to be generally aligned with a user's eyes and adapted to receive a lens, a lower rigid frame adapted to be generally aligned with a user's mouth area, said frames being spaced apart, a full face seal interconnecting said frames and adapted to extend peripherally in sealing engagement with a user's face, said seal being constructed of flexible, resilient material for sealing engagement with face surfaces, said face seal including resilient adjustment zones formed between said frames to enable the frames to individually conform with facial contours of a user, said lower rigid frame including an open area adapted to be generally aligned with said user's mouth area, and a removable adaptor pod mounted on said lower frame to enable access to said user's mouth without removing the full face mask.

11. The full face mask as defined in claim 10, wherein said face seal forms self-contained spaces, one of which is adapted to be aligned with a user's mouth and chin.

12. The full face mask as defined in claim 10, wherein said adaptor pod and lower frame include detachable connections that permit manual removal of said adaptor pod while the mask is being worn by a user, said lower frame being sealingly connected to said adaptor pod.

13. The full face mask as defined in claim 10, wherein said frames include a head harness attached thereto by adjustable fasteners for pulling the frames and full face seal toward facial surfaces or a user for sealing the self-contained spaces to a face of a user.

14. The full face mask as defined in claim 10, wherein said full face seal includes an inwardly extending, inclined flap extending around the periphery of said full face seal, said flap including a thin, flexible inner edge for sealing contact with facial surfaces of a user engaged by the full face seal.

* * * * *

UNITED STATES PATENT AND TRADEMARK OFFICE

CERTIFICATE OF CORRECTION

PATENT NO. : 6,626,178 B2
DATED : September 30, 2003
INVENTOR(S) : William Bevly Morgan et al.

It is certified that error appears in the above-identified patent and that said Letters Patent is hereby corrected as shown below:

Drawings,
Sheet 6, Figure 6, replace with the following Figure 6.

Column 11,
Lines 49-64, delete the last full paragraph.

Signed and Sealed this

Twenty-first Day of December, 2004

JON W. DUDAS
*Director of the United States Patent and Trademark Office*